United States Patent [19]

Perkins et al.

[11] 4,276,003

[45] Jun. 30, 1981

[54] RECIPROCATING PISTON PUMP SYSTEM WITH SCREW DRIVE

[75] Inventors: Gerald S. Perkins; Nicholas R. Moore, both of Altadena, Calif.

[73] Assignee: California Institute of Technology, Pasadena, Calif.

[21] Appl. No.: 961,398

[22] Filed: Nov. 16, 1978

Related U.S. Application Data

[63] Continuation of Ser. No. 774,229, Mar. 4, 1977, Pat. No. 4,145,165.

[51] Int. Cl.[3] ..... F04B 17/00

[52] U.S. Cl. ..... 417/415; 74/57; 184/24

[58] Field of Search ..... 417/415, 418, 410; 74/57, 58; 92/31, 33; 184/14, 24

[56] References Cited

U.S. PATENT DOCUMENTS

| | | | |
|---|---|---|---|
| 845,351 | 2/1907 | Hanson | 184/14 X |
| 1,435,892 | 11/1922 | Cole | 417/415 |
| 1,552,068 | 9/1925 | Lee | 417/415 |
| 1,713,219 | 5/1929 | Eisenhauer | 74/57 |
| 2,505,253 | 5/1950 | Haggardt | 417/415 X |
| 2,932,255 | 4/1960 | Neukirch | 417/429 |
| 4,145,165 | 3/1979 | Perkins et al. | 417/418 |

*Primary Examiner*—Richard E. Gluck

*Attorney, Agent, or Firm*—Freilich, Hornbaker, Wasserman, Rosen & Fernandez

[57] ABSTRACT

A pump system of the reciprocating piston type is described, which facilitates direct motor drive and cylinder sealing. A threaded middle potion of the piston is engaged by a nut connected to rotate with the rotor of an electric motor, in a manner that minimizes loading on the rotor by the use of a coupling that transmits torque to the nut but permits it to shift axially and radially with respect to the rotor. The nut has a threaded hydrostatic bearing for engaging the threaded piston portion, with an oil-carrying groove in the nut being interrupted. A fluid emitting seal located at the entrance to each cylinder, can serve to center the piston within the cylinder, wash the piston, and to aid in sealing. The piston can have a long stroke to diameter ratio to minimize reciprocations and wear on valves at high pressures. The voltage applied to the motor can be reversed prior to the piston reaching the end of its stroke, to permit pressure on the piston to aid in reversing the motor.

6 Claims, 11 Drawing Figures

FIG. 3
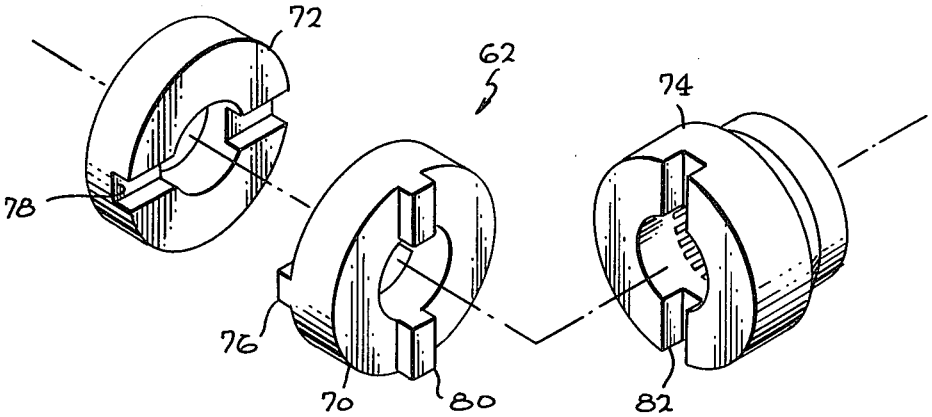
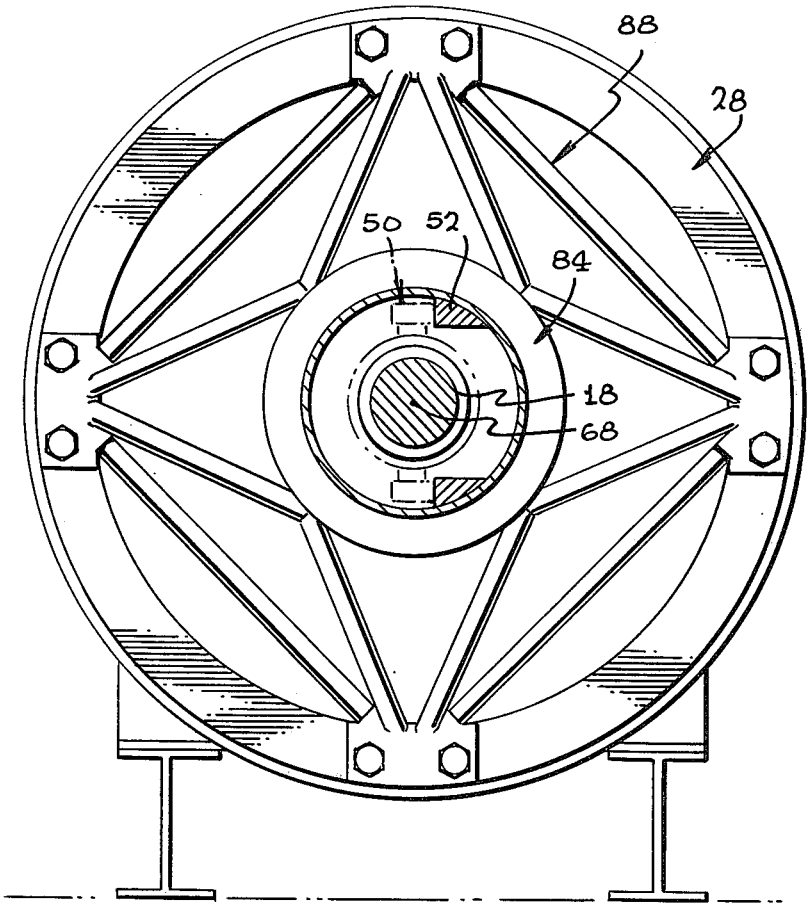
FIG. 4

FIG. 7
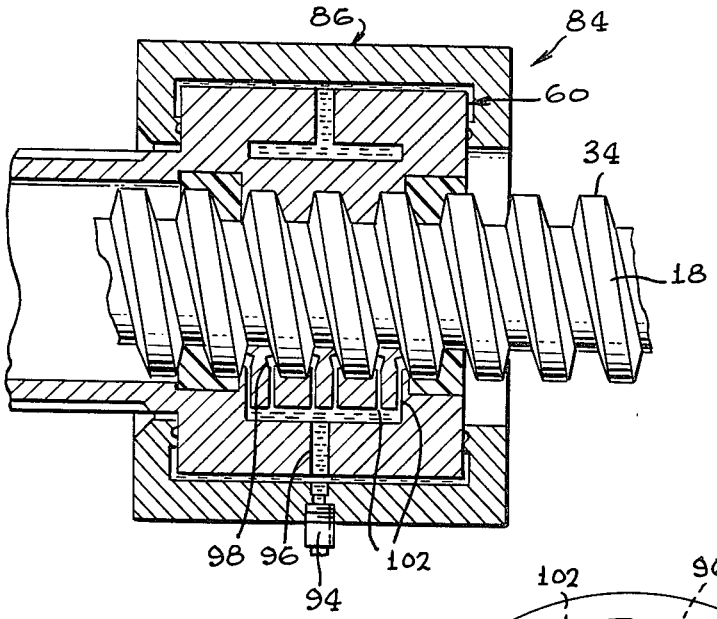
FIG. 9
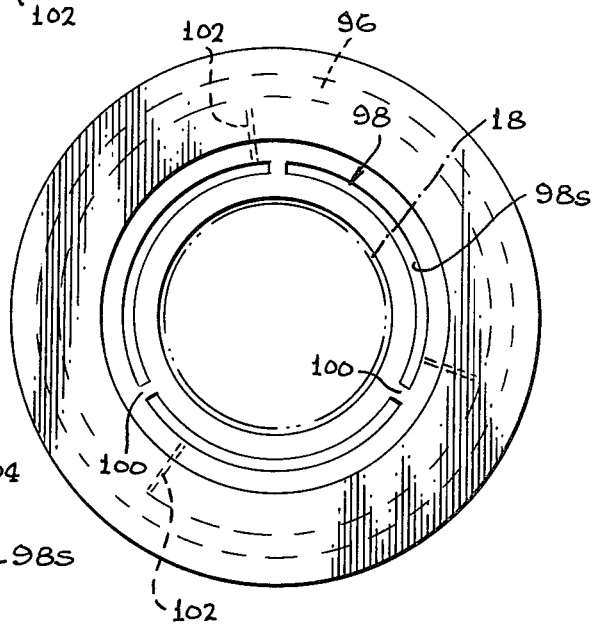
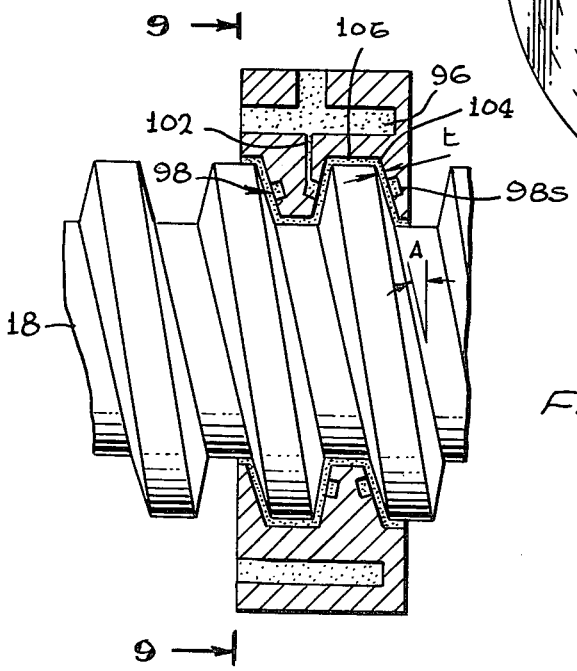
FIG. 8

RECIPROCATING PISTON PUMP SYSTEM WITH SCREW DRIVE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

CROSS REFERENCE TO RELATED APPLICATIONS

This is a continuation in part of Ser. No. 774,229 filed Mar. 4, 1977, now U.S. Pat. No. 4,145,165.

BACKGROUND OF THE INVENTION

Pumps utilized for high volume, high pressure pumping of abrasive fluids such as drilling mud utilized in drilling hydrocarbon wells, are subject to high maintenance problems. A pump construction which simplified driving of the pumping elements from a motor while minimizing the load on the motor, which minized wear on the valves and seals, and which enabled a more compact and simplified pumping system to be constructed, would be of considerable value in pumping drilling mud under high pressure as well as in other pumping applications.

SUMMARY OF THE INVENTION

In accordance with one embodiment of the present invention, a pump is provided which can be economically constructed and which enhances the lifetime of the pump and various valves and seals utilized therewith. The pump includes a long piston rod with a threaded middle portion, and with opposite ends received in a pair of pump cylinders. A reversible motor located at the middle portion of the rod, includes a rotor which drives a nut engaged with the rod to reciprocate the rod. The piston rod has a long stroke, such as more than five times the diameter of either end of the rod, so that a large amount of fluid is pumped at every stroke of the rod to minimize wear on valves and seals. The rod-engaging nut is of a low friction hydrostatic bearing type, and the motor voltage is reversed as the rod approaches the end of its stroke, so that high fluid pressure on the end of the rod is converted to torque on the nut which aids in reversal of the nut to minimize the load on the motor during reversal.

The nut which drives the piston rod, is coupled to the motor rotor by a coupling that transmits torque to the nut but allows it to shift axially and radially with respect to the rotor. Accordingly, the rotor can be supported by its own ordinary bearings, because the heavy piston rod load is taken up by separate bearings applied to the nut. The nut has hydrostatic thread bearings, wherein the typical oil-distributing groove has multiple interruptions to form isolated sectors along the helical oil-distributing groove. As a result, as the thread rod approaches a sector, a greater pressure is applied to the rod thereat to center it to thereby enable the nut to withstand higher loads. The seal structure at the entrance to each cylinder, can include a ring device with a fluid-emitting groove that aids in centering the piston rod and in washing it.

The novel features of the invention are set forth with particularity in the appended claims. The invention will be best understood from the following description when read in conjunction with the accompanying drawings.

BRIEF DESCRIPTION OF THE DRAWINGS

FIG. 3 is an exploded perspective view of a coupling of the pump of FIG. 2.

FIG. 4 is a view taken on the line 4—4 of FIG. 2.

FIG. 7 is a partial sectional view of a hydrostatic bearing constructed in accordance with another embodiment of the invention.

FIG. 8 is a sectional view of a portion of the bearing of FIG. 7.

FIG. 9 is a view taken on the line 9—9 of FIG. 8.

DESCRIPTION OF THE PREFERRED EMBODIMENTS

Figure 1:
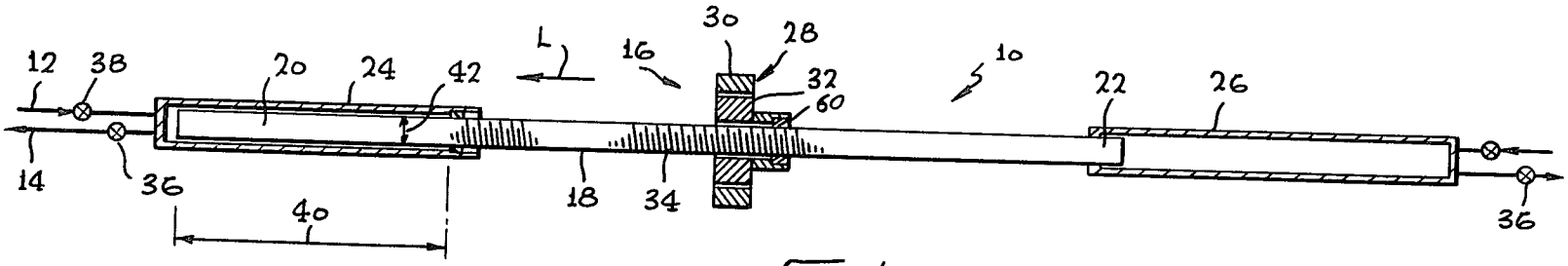
FIG. 1 is a simplified sectional view of a pump constructed in accordance with the present invention.

FIG. 1 illustrates a pump or pumping system 10 which receives a fluid through an input line 12 and which delivers the fluid through an output line 14. Pumping is accomplished by a pumping arrangement 16 which includes a long piston or piston rod 18 whose ends 20, 22 are received in cylinders 24, 26. The piston rod is reciprocated by an electric motor 28 which includes a stator 30 and a rotor 32, the rotor being threadably coupled to a threaded middle portion 34 of the piston rod. When the piston moves in the direction of arrow L, fluid is pumped out of the cylinder 24 and through an outlet check valve 36 to the output line 14, while movement of the rod in the opposite direction causes inflow of fluid through another check valve 38 into the cylinder. Another pair of valves is similarly coupled to the other cylinder 26.

The piston rod 18 has a very long stroke length 40, which is more than five times the diameter 42 of either end of the piston. It would be possible to construct a more compact pumping system by utilizing a much shorter piston rod and shorter cylinders, and by reciprocating the rod more frequently to pump the same volume as is pumped by the long pump apparatus 16, without increasing the velocity of the piston or the required input power. However, the long stroke 40 provides a unique advantage when very high pressures and abrasive material are being pumped, of increasing the lifetime of the valves, and particularly the outlet valves 36. This is accomplished because the longer stroke of the very long pump results in fewer openings and closings of the valve 36. Studies that have been conducted show that the greatest wear on a valve which passes high pressure and abrasive material, occurs during the closing of the valve. The closing of a check valve occurs as the piston rod approaches the end of its stroke and begins reversing, and at that time a very high pressure differential may exist across the valve 36. For example, a pump that pumps at 20,000 psi may produce only a small pressure drop of only several psi across the check valve 36 during the middle of its stroke. The fluid may move at only a moderate speed through the wide open valve, causing little wear. However, as the piston begins reversing, and the check valve 36 begins closing, there may be almost no pressure in the cylinder 24, and therefore a pressure differential of close to 20,000 psi may exist across the check valve 36. During the instant when the valve is closing, a very rapid flow of abrasive material may occur through the rapidly constricting opening of the valve which is closing. Our investigations have shown that this regurgitant flow is a major cause of valve wear. Thus, by utilizing an extraordinarily long stroke length, the frequency of valve closings is reduced, and the life of the valves are consequently increased.

Figure 2:
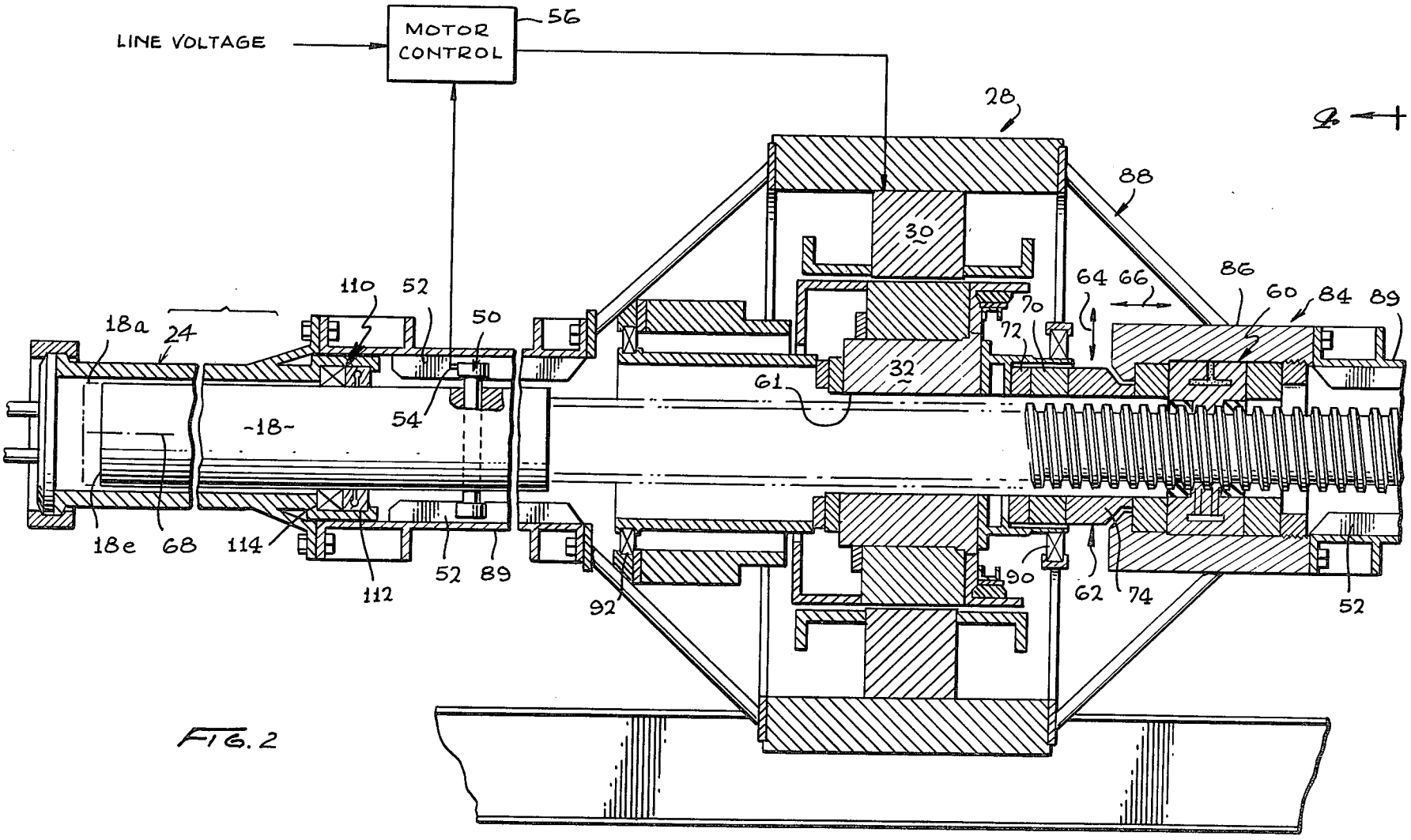
FIG. 2 is a more detailed sectional view of the pump of FIG. 1.

As shown in FIG. 2, the piston 18 carries an anti-rotation device 50 having a pair of rollers at its ends, that bear against a pair of tracks 52, to prevent rotation of the piston rod. An optical limit switch 54 senses when the piston approaches the end of its stroke, to transmit a signal to a motor control 56, which then reverses the voltage applied to the motor 28 to urge its reversal. The piston 18 continues moving until its end reaches the position 18*a*, due to inertia. Between the time when the voltage applied to the motor is reversed to urge rotation in the opposite direction, and the actual end of the piston stroke, pressure continues to be applied against the end 18*e* of the piston, urging it to reverse direction. A threaded member or nut 60 which is driven by the motor rotor 32 to advance the piston, lies beyond one axial end of the rotor, while the rotor has a central hole 61 large enough to provide clearance around the piston. The nut 60 is of a hydrostatic type, which provides a very low friction and can support a large load. The nut-to-piston friction is low enough compared to the angle of the helical thread, that a force applied to the end of the piston 18 tends to cause the nut 60 to rotate. Thus, during the last portion of the piston stroke, as its end is approaching the position 18*a*, the large force in the pipeline acting against the piston end, is effective in aiding the nut 60 to reverse direction, and therefore to aid in reversing the motor rotor 32. The use of high pipeline pressure to aid in reversing the motor, reduces the reversing time for the motor, so that the pulse transient of the pump output is minimized, and can also minimize the motor load.

The nut 60 which is driven by the motor rotor 32, is coupled to the rotor by an Oldham type coupling 62. This coupling permits the threaded bearing or nut 60 to shift in a radial direction as indicated by arrow 64 and to shift in an axial direction as indicated by arrow 66, with respect to the rotor 32, and yet permits the rotor to apply a large torque about the axis of rotation 68 of the motor rotor 32. FIG. 3 shows details of the coupling which includes a free-floating middle element 70 engaged with an element 72 fixed to the rotor and another element 74 coupled to the nut 60. The middle element 70 has a projection 76 received in a groove 78 of the rotor-connected element 72, and has another projection 80 received in a groove 82 of the nut-driving element 74. It can be seen that the coupling permits both axial and radial shifting of the nut-coupled element 74 with respect to the rotor coupled element 72. Additional axial movement of the nut coupled element 74 is permitted by the use of a spline connection to the nut.

The nut assembly 84 (FIG. 2) which includes the rotating nut 60, includes a nut bearing 86 that is coupled by a mount structure 88 to the motor housing. The mount structure 88 holds the nut bearing 86 in position with respect to the motor, and also holds a shield 89 that connects to one of the pump cylinders 26. The motor rotor 32 is supported by ball bearings 90, 92 which are designed to withstand only relatively small axial and radial forces, and yet maintain the rotor precisely concentric with the motor stator 30. The large axial forces and moderately large radial forces applied by the piston rod 18, are withstood by a hydrostatic bearing of the nut bearing 86.

The provision of the coupling 62 to connect the motor rotor and nut so as to permit slight relative shifting, facilitates construction and assembly of the system. The rotor bearings can be installed by the motor manufacturer and the motor tested, apart from the rest of the pump, and with the degree of bearing precision adapted to the rotor. The motor can be a self contained module useful in other pump sizes or for other applications. When the motor is assembled in the complete pump, it is not necessary to precisely align the rotor bearing and nut bearing 86. It may be noted that the nut bearings must be aligned with some degree of accuracy with the cylinders 24, 26, but the long shields 89 connecting the cylinders to the nut bearing 86 permit some flexing.

FIG. 7 illustrates details of the nut assembly 84 which includes the rotating nut 60 and the nut housing or bearing 86. The nut housing 86 includes a fitting 94 which receives pressured hydraulic fluid that provides a hydrostatic bearing for supporting the nut 60 against radial and axial thrust. The nut 60 includes a conduit 96 which receives the pressured fluid and delivers it to a groove 98, for application of the hydraulic fluid to the threaded portion 34 of the piston rod 18. The pressure of the fluid is utilized to center the nut with respect to the piston rod, both axially and radially.

Prior art threaded hydrostatic bearings have been useful as low friction precision lead screw bearings having the advantages of no static friction, minimum wear to maintain accuracy, no backlash, excellent positional repeatability, high stiffness, and an ability to compensate for small errors in the spacing of the threads. However, such hydrostatic thread bearings have not been found satisfactory for high load conditions, because proper operation of such bearings requires that the nut always be maintained concentric with the axis of the lead screw. If the nut-to-screw clearances change even slightly, as where the nut moves eccentric to the lead screw axis, circumferential migration is induced in the oil film. This causes the oil to seek and find the largest clearance region, so that the oil drains from the high pressure area and the film at the more heavily loaded side of the bearing no longer separates the screw and nut bearing under high load conditions.

The present nut 60 is constructed to avoid such migration of oil from areas of high loading, by providing interruptions in the groove 98 that distributes oil about the nut to provide an oil film for supporting the screw. As shown in FIG. 9, there are preferably three interruptions 100 in the oil-distributing groove 98 along each 360° turn of the spiral. As a result of the division of the oil-holding groove 98 into multiple isolated pockets or sectors 98*s*, the lead screw-nut assembly is self regulating. That is, any slight movement of the screw 18 closer to one recess or sector 98*s* will compress the oil trapped therein so it is under a higher pressure, and will relieve the pressure on an opposite sector from which the screw moves away to lower the pressure thereat. This pressure differential tends to restore the screw to a position in alignment with the nut. This construction utilizing an interrupted oil-distribution groove, results in the needs for multiple restricted feeds 102, to separately feed oil into each of the isolated sectors 98s. For example, the pressure in the oil distribution conduit 96 may be 5000 psi, and may decrease to 4000 psi in each sector 98s. When a lead screw moves slightly closer to one sector 98s, it reduces the thickness t (FIG. 8) of the oil film 104 adjacent to that sector, so there is a slightly lower outflow of oil to the peripheral region 106 of the nut. At the same time, oil continues to flow from a feed conduit 102 to that sector, so that the slightly increased pressure in that sector is maintained. The fact that the oil films 104 extend at an angle A to the radial direction, results in applying a radial restoring force as well as an axial thrust, so that the oil film helps to keep the nut and screw concentric, and the nut can operate without separate radial bearings to center the screw.

Figure 5:
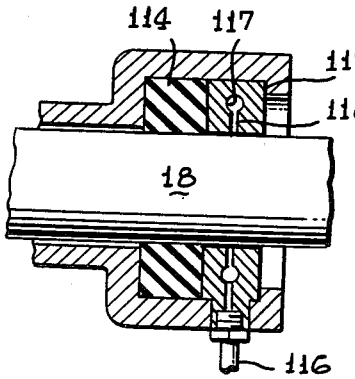
FIG. 5 is a view of a region of the pump apparatus of FIG. 2.

Each cylinder such as 24, has a larger bore than the piston end, to provide clearance around the piston. A seal assembly 110 (FIG. 2) at the entrance to each cylinder can include a fluid-emitting seal device 112, either alone or in combination with a solid conventional contact seal 114. As shown in FIG. 5, the fluid-emitting device or seal 112 is supplied with pressured fluid through a conduit 116, the fluid flowing into a channel 117 and through a restricted feed 118 against the piston rod 18. The fluid-emitting seal 112 serves to help center the piston 18, to minimize radial loading on the seal 114. A conventional contact seal 114 may be desirable where very high pressures such as 20,000 psi are being pumped, because fluid such as water emitted under such high pressures from a fluid-emitting seal could damage the piston 18, athough it may be possible to take precautions to avoid such wear on the piston.

Figure 6:
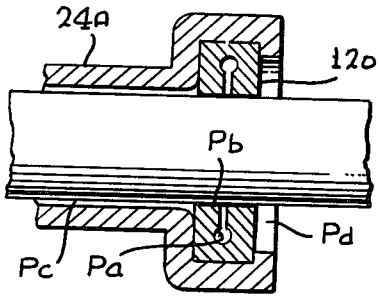
FIG. 6 is a partial sectional view of a seal arrangement constructed in accordance with another embodiment of the invention, which can be utilized in place of the seal arrangement shown in FIG. 5.
Figure 6B:
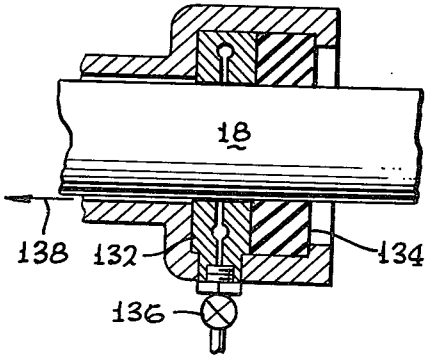
FIG. 6B is a partial sectional view of a seal arrangement constructed in accordance with another embodiment of the invention.
Figure 6A:
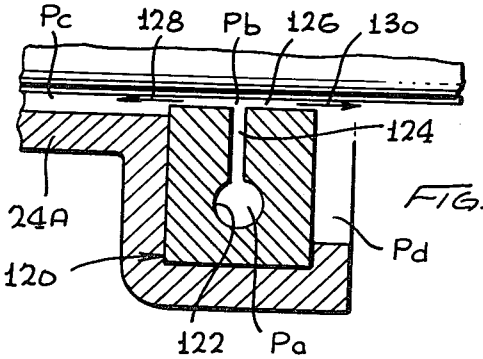
FIG. 6A is a view of a portion of the seal arrangement of FIG. 6.

FIGS. 6 and 6A show a fluid seal 120 which is utilized as a seal to keep in high pressure fluid in the cylinder 24A, as well as to center the piston and wash it. In one example, the pressure $P_c$ in the cylinder may reach a maximum of perhaps 1,000 psi, while the pressure $P_a$ supplied to the distribution channel 122 of the seal may be about 50% higher or about 1,5000 psi. Water or other cleaning fluid supplied to the channel 122 passes through a restricted feed 124, where it reaches the inner surface 126 of the seal, where the pressure $P_b$ is very slightly over the cylinder pressure, such as 1002 psi at the center of the seal. This results in fluid sweeping in the direction of arrow 128 into the cylinder 24A, so that drilling mud or the like does not readily pass to the inside surface 126 of the seal to wear and block it. This washing action aids in prolonging the life of the seal as well as minimizing friction of the piston on the seal. The fluid also sweeps in the direction of arrow 130 into the environment. In addition to washing the piston, the fluid pressure centers the piston in a low friction and long life sealing arrangement, and provides a sealing action to prevent the loss of drilling mud or the like in the cylinder. The flow in the direction of arrow 130 can be minimized by providing an additional ordinary solid seal beyond the fluid seal 120.

FIG. 6B shows a fluid-emitting seal 132 which is utilized in conjunction with a conventional contact seal 134, in a pump that pumps abrasive material such as drilling mud at high pressures such as 20,000 psi. The fluid-emitting seal device 132 is located on the inner side of the contact seal 134. A washing fluid is supplied at a pressure such as 1000 psi through a check valve 136 to the seal device 132. During forward movement of the piston 18 into the cylinder, no washing fluid is emitted, and the contact seal holds in the high pressure. However, during the backstroke, when cylinder pressure has fallen to a low level, fluid is emitted from the device 132 to flow in the direction of arrow 138 into the cylinder. This fluid washes the piston to resist the outflow of mud onto the contact seal 134 to prolong its life.

Thus, the invention provides a pump assembly which can be constructed relatively compactly and economically and which can pump large quantities of fluid at high pressures. Wear on the valves and other components of the system is minimized by utilizing a very long stroke such as more than five times the diameter of the piston ends, to pump a given amount of fluid with fewer strokes and therefore fewer openings and closings of the valves, than would be possible with a corresponding shorter stroke pump. The piston rod has a screw portion driven by a rotating nut of very low friction, and a motor which drives the nut is reversed prior to the piston reaching the end of its stroke, so that high pressure on the end of the piston is efficiently utilized to help reverse the motor. The nut is coupled to the motor rotor by a flexible coupling that permits the nut and rotor to shift axially and radially with respect to one another, so that relatively light bearings can be utilized to support the motor rotor, and separate heavy duty bearings can be utilized for the nut. A hydrostatic nut construction is utilized with an interrupted oil-distribution groove and with separate feeds to the different groove sectors, to enable the nut to withstand very high loading. The cylinder seal arrangement can include a fluid-emitting seal which aids in washing and centering the piston as well as sealing fluid in the cylinder.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. A pump comprising:

a cylinder having inlet and outlet means for receiving and allowing the exit of fluid;

a piston having an end portion in said cylinder and a threaded portion;

a motor having a stator and a rotor;

nut means coupled to said rotor to rotate with it, and threadably engaged with said piston threaded portion, said nut means including walls defining an internal thread, a channel extending in a helix along said walls, and pressured fluid feed means coupled to said channel to provide hydraulic fluid to said channel;

said channel having a plurality of interruptions therealong forming barriers to the free flow of fluid between channel portions that lie on opposite sides of the barrier, and said feed means including a plurality of restricted feed conduits leading to different of said channel portions to supply fluid thereto.

2. The pump described in claim 1 wherein:

said barriers are positioned so there are at least three barriers in every approximately 360° along said internal thread.

3. In a pump with an inlet and outlet and that includes a reciprocating piston with a screw portion that is advanced by a motor having a rotor, the improvement of a hydrostatic nut apparatus for transmitting power from the rotor to the piston, comprising;

a hydrostatic nut which includes walls defining a hylical groove, including side walls and a radially outer wall, for threadably receiving said piston screw portion, said side walls having a plurality of fluid-holding recesses therein spaced along the helical groove; and pressured fluid supply means coupled to said recesses to supply pressured fluid thereto.

4. The pump described in claim 3 including:

a nut housing rotatably supporting said hydrostatic nut; and a coupling extending between said rotor and said nut, said coupling constructed to transmit torque but to permit at least slight shifting in position of said nut relative to said rotor.

5. Pumping apparatus comprising:

a piston having a threaded portion and having an end;

a nut threadably engaged with said piston;

a motor having a stator, and having a rotor coupled to said nut to rotate it and to move the piston axially as the rotor turns;

a cylinder receiving said end of said piston, and having inlet and outlet valves; and means for energizing said motor to rotate said rotor;

said nut includes walls defining an internal thread with side walls, said side walls having a plurality of recesses spaced along the helix defined by the internal thread for holding hydraulic fluid, and means for applying hydraulic fluid to said recesses including a plurality of restricted feed conduits leading to said recesses to supply fluid thereto.

6. A pump comprising:

a piston with a threaded portion;

a cylinder having an inlet and an outlet, and having an open end for slideably receiving said piston, said piston being small enough in diameter to leave a clearance between it and said cylinder;

means for reciprocating said piston including a rotor, a nut engaged with the threaded piston portion, and means coupling said rotor and nut; and sealing means located at said cylinder open end to seal in fluid, including a contact seal surrounding and in contact with said piston to seal thereagainst, and a fluid-emitting member closely surrounding said piston but with a gap between them and means for applying pressured fluid to said gap, whereby to minimize wear on the contact seal;

said nut including walls defining an internal thread with side walls, said side walls having a plurality of recesses spaced along the helix defined by the internal thread for holding hydraulic fluid, and means for applying hydraulic fluid to said recesses including a plurality of restricted feed conduits leading to said recesses to supply fluid thereto.

* * * * *